United States Patent [19]

Heien

[11] 4,000,713

[45] Jan. 4, 1977

[54] COMBINED MOORING AND TRANSFER MEANS FOR OIL AND OTHER LIQUID

[76] Inventor: Sigurd Heien, Aslokkveien 82, 1362 Billingstad, Norway

[22] Filed: May 1, 1975

[21] Appl. No.: 573,618

[52] U.S. Cl. ..... 114/294; 9/8 P; 114/230; 141/388

[51] Int. Cl.[2] ..... B63B 21/00

[58] Field of Search ..... 9/8 P; 114/230, 206 R, 114/.5 D; 141/388, 141

[56] References Cited

UNITED STATES PATENTS

| | | | |
|---|---|---|---|
| 3,295,489 | 1/1967 | Bossa | 114/206 R |
| 3,466,680 | 9/1969 | Schirtzinger | 114/230 X |
| 3,756,293 | 9/1973 | Adler et al. | 141/388 |
| 3,929,087 | 12/1975 | Montgomery | 114/206 R |

FOREIGN PATENTS OR APPLICATIONS

| | | | |
|---|---|---|---|
| 7,017,859 | 5/1971 | Netherlands | 114/230 |

*Primary Examiner*—Trygve M. Blix
*Assistant Examiner*—Gregory W. O'Connor
*Attorney, Agent, or Firm*—Young & Thompson

[57] ABSTRACT

A combined mooring and transfer system for oil and other liquid to a ship from an off-shore installation which rests on the sea bed and extends above sea level, comprising a floating transfer hose from the part above sea level and a mooring hawser from the sea bed part of the installation, the free ends of both being connected to a floating buoy to be picked up by an approaching ship.

4 Claims, 3 Drawing Figures

COMBINED MOORING AND TRANSFER MEANS FOR OIL AND OTHER LIQUID

The present invention relates to a combined mooring and transfer means for oil and other liquids which is to be transferred to a ship from an off-shore production platform, storage tank, pipeline or other installation which rests on the sea bed and partly extends above sea level, comprising a floating mooring hawser and a floating hose which both may be hauled aboard that part of the installation which extends above sea level.

In such transfer means it is usual that the floating transfer hose extends from a moored buoy to which the ship is moored, and the free end of the hose is hauled aboard and connected to the ship. In deep waters and in heavy seas the transfer hose is exposed to great strain and therefore it presents great danger for breakage and oil pollution.

The object of the invention is to provide mooring and transfer means which makes a transfer of this type easier and safer than before.

According to the invention, this is achieved in that one end of the mooring hawser is connected to that part of the installation which rests on the sea bed and the other end of the hawser is connected to a floating buoy which also is connected to the transfer hose one end of which is connected to that part of the installation which extends above sea level.

Preferably, the floating buoy is connected by means of a hawser to an end-buoy which is connected to a hauling wire and has a hanger on the underside for support of the other end of the transfer hose which is to be connected to the ship.

If a nylon hawser is used as a mooring hawser it may be protected from wear against the connecting part of the installation if further according to the invention the connection between the one end of hawser and that part of the installation which rests on the sea bed contains a steel wire one end of which is connected to the installation and the other end to the nylon hawser and a submerged buoy. When the hawser is not hauled tight the submerged buoy will then lift the nylon part of the mooring free from the installation.

An embodiment of the invention will be described below with reference to the drawing, wherein.

Figures 1, 2, 3:
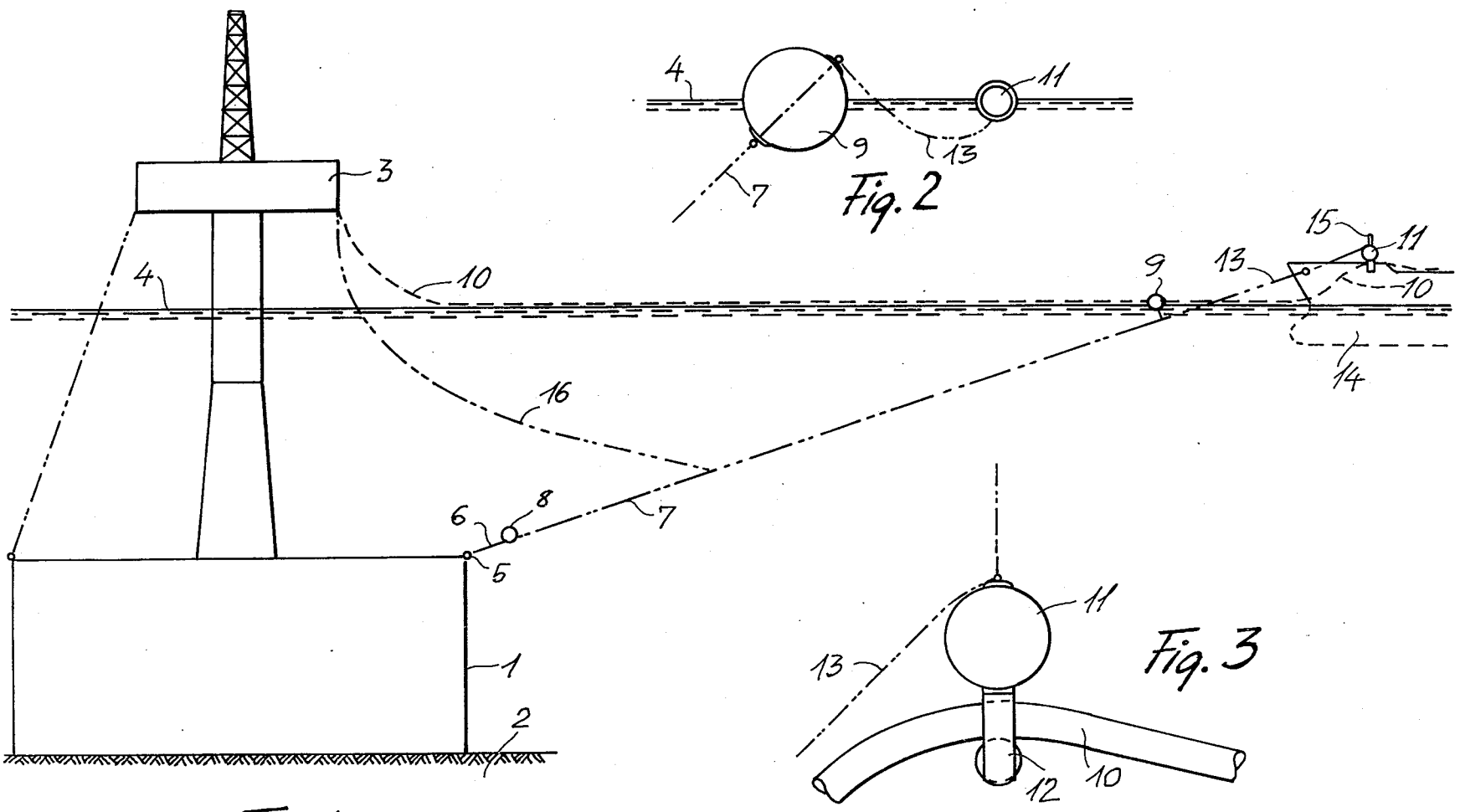
FIG. 1 shows in elevation a mooring and transfer means according to the invention.
FIG. 2 shows in the same way, but enlarged a detail of FIG. 1.
FIG. 3 shows in the same way, but enlarged another detail of FIG. 1.

The apparatus consists of an oil production platform with a part 1 resting on the sea bed 2 and a part 3 extending above sea level 4. To one point 5 on the part 1 of the platform is connected one end of a steel cable 6 the other end of which is connected to one end of a nylon hawser 7 and a submerged buoy 8. Near its other end, the nylon hawser 7 is end connected to a floating buoy 9 which is also connected to a floating transfer hose 10 near one end, the other end of hose 10 being connected to that part 3 of the platform which extends above sea level. The other end of the nylon hawser 7 is connected to an end buoy 11 which on the underside has a hanger 12 for support of the one end of the transfer hose 10 and which is also connected to a hauling wire 13 for hauling the end buoy 11 with the nylon hawser and the transfer hose aboard a ship 14 by means of a winch 15, for mooring of the ship and connection of the transfer hose to the ship. The nylon hawser 7 is between the buoys 8 and 9 further connected to a nylon rope 16 for hauling the hawser aboard the part 3 of the platform together with the transfer hose 10 and the buoys 9 and 11 after being freed from the ship when loaded.

In this way the tensioning forces owing to wind, current and wave motion are taken up by the elastic nylon hawser, so that the forces on the transfer hose are lessened and the danger of breakage and oil pollution is reduced.

For mooring and connection of the transfer hose to an approaching ship, a line connected to the end buoy may be shot over the bow of the ship to haul the buoy aboard as the mooring hawser and the transfer hose are payed out from the part 3 of the platform.

Having described my invention, I claim:

1. Combined mooring and transfer means for oil and other liquid which is to be transferred to a ship from an off-shore production platform, storage tank, pipeline and other installation which rests on the sea bed and partly extends above sea level, comprising a floating mooring hawser which may be hauled toward that part of the installation which extends above sea level and a floating hose which may be hauled aboard that part of the installation which extends above sea level, wherein the one end of the mooring hawser is connected to that part of the installation which rests on the sea bed and the other end is connected to a buoy which also is connected to the transfer hose, said buoy having a hanger on the underside for support of that end of the transfer hose which is to be connected to the ship, one end of the transfer hose being connected to that part of the installation which extends above sea level, and means for hauling said mooring hawser toward that part of the installation which extends above sea level.

2. Combined mooring and transfer means according to claim 1, wherein the mooring hawser is a nylon hawser and the connection between the one end of which and that part of the installation which rests on the sea bed contains a steel cable one end of which is connected to the installation and the other end to the nylon hawser and a submerged buoy.

3. Combined mooring and transfer means according to claim 1, wherein said hauling means comprises a rope connected at one end to that part of the installation which extends above sea level and at the other end to said hawser.

4. Combined mooring and transfer means according to claim 3, in which said other end of said rope is connected to a point on said hawser intermediate the ends of said hawser.

* * * * *